United States Patent [19]

Mogami et al.

[11] Patent Number: 4,945,236

[45] Date of Patent: Jul. 31, 1990

[54] DIRECT IMAGING TYPE SIMS INSTRUMENT HAVING TOF MASS SPECTROMETRIC MODE

[75] Inventors: Akinori Mogami; Motohiro Naitoh, both of Tokyo, Japan

[73] Assignee: Jeol Ltd., Tokyo, Japan

[21] Appl. No.: 344,767

[22] Filed: Apr. 28, 1989

[30] Foreign Application Priority Data

Apr. 28, 1988 [JP] Japan ..... 63-107241

[51] Int. Cl.[5] ..... H01J 49/40

[52] U.S. Cl. ..... 250/309; 250/281; 250/282; 250/287; 250/296

[58] Field of Search ..... 250/309, 287, 296, 310, 250/311, 281, 282

[56] References Cited

U.S. PATENT DOCUMENTS

| | | | |
|---|---|---|---|
| 4,435,642 | 3/1984 | Naugebauer et al. | 250/296 |
| 4,489,237 | 12/1984 | Litherland et al. | 250/282 |
| 4,625,112 | 11/1986 | Yoshida | 250/287 |
| 4,645,928 | 2/1987 | Naito | 250/296 |
| 4,774,408 | 9/1988 | Gohlke | 250/287 |
| 4,778,993 | 10/1988 | Waugh | 250/309 |
| 4,810,880 | 3/1989 | Gerlach | 250/310 |
| 4,866,267 | 9/1989 | Matsuda et al. | 250/281 |
| 4,912,326 | 3/1990 | Naito | 250/296 |

*Primary Examiner*—Jack I. Berman
*Assistant Examiner*—Kiet T. Nguyen
*Attorney, Agent, or Firm*—Webb, Burden, Ziesenheim & Webb

[57] ABSTRACT

There is disclosed a direct imaging type SIMS (secondary ion mass spectrometry) instrument having a mass analyzer comprising superimposed fields. The superimposed fields consist of a toroidal electric field and a uniform magnetic field substantially perpendicular to the electric field. In an imaging mode, and ion image of the region of a sample which is irradiated with a primary beam is focused onto a two-dimensional ion detector by the mass analyzer having the superimposed fields. In TOF (time-of-flight) mass spectrometric mode, the intensity of the magnetic field of the superimposed fields is reduced down to zero to use only the electric field. Pulsed secondary ions from the surface of the sample are passed through the electric field and are separated according to mass with the lapse of time on the principle of TOF mass spectrometry.

5 Claims, 5 Drawing Sheets

DIRECT IMAGING TYPE SIMS INSTRUMENT HAVING TOF MASS SPECTROMETRIC MODE

BACKGROUND OF THE INVENTION

The present invention relates to an instrument for conducting secondary-ion mass spectrometry (SIMS) and, more particularly, to a direct imaging type SIMS instrument which can make analysis of a sample by time-of-flight (TOF) mass spectrometry.

Secondary-ion mass spectrometry involves bombarding a sample with a beam of primary particle ions and analyzing the secondary ions that emanate from the sample surface. The secondary ions are then introduced into a mass analyzer, where they are mass analyzed. As a result, the composition of a microscopic region on the surface of the solid sample can be elucidated. Instruments for conducting SIMS are broadly classified into two types: scanning type which scans an analyzed region with a sharply focused primary beam to obtain an ion image; and direct imaging type which bombards the whole analyzed region with a primary beam of a relatively large diameter and obtaining an ion image on the principle of an ion microscope.

FIG. 1 shows the ion optics of one example of the direct imaging type SIMS instrument. A primary ion beam $I_1$ produced from an ion source IS has a relatively large diameter. This beam is caused to impinge on the whole analyzed region on a sample S. Secondary ions $I_2$ emanating from this region are sent to a mass analyzer MS through a transfer optics TO. In this mass analyzer, only secondary ions having a certain mass are selected and then projected via a projector lens Lp onto a two-dimensional detector such as a fluorescent screen FS. Thus, an ion image is obtained with the certain mass.

In the ion optics shown in FIG. 1, electrostatic lenses $L_{11}$ and $L_{12}$ are used to form the primary ion beam. The transfer optics TO consists of electrostatic lenses $L_{21}$, $L_{22}$, $L_{23}$. A slit $SL_1$ is disposed at the entrance to the mass analyzer MS. The ion optics further includes an intermediate lens LΩ, an energy slit $SL_2$, and a mass-selecting slit $SL_3$.

In the instrument shown in FIG. 1, the secondary ions emitted from the sample surface have a large energy spread and, therefore, the mass analyzer MS consists of a double-focusing mass analyzer in which a spherical electric field EF and a uniform sector magnetic field MF are connected in tandem. The direct imaging type SIMS instrument as shown in FIG. 1 is disclosed by George Slodzian in his book *Applied Charge Particle Optics*, 1980, in the third chapter (III. Direct Imaging Instruments), pp. 17–19, of an article entitled "Microanalyzers Using Secondary Ion Emission."

In the aforementioned prior art instrument, it is inevitable that the mass analyzer has a large-scaled structure, because it consists of a series combination of the electric field, the lens LΩ, and the magnetic field. The prior art instrument can only provide mass-filtered ion images in which the contrast is given by the presence or absence of ions of a specified mass.

It is known that irradiation of a primary ion beam can hardly ionize special substances such as gold, because the ionization efficiency widely differs among elements or substances. In so-called laser pulsed ionization, a sample is ionized with a pulsed laser beam of a high intensity. It is known that with this ionization process, almost all substances including gold can be ionized at substantially the same high efficiency.

The secondary ion yield ratio (number of emitted secondary ions/number of sputtered neutral particles) of some kinds of samples is extremely small and only a small quantity of secondary ions can be obtained by irradiation by a primary ion beam. In such case, the produced secondary neutral particles can be ionized by irradiation of a pulsed laser beam, for mass analysis. This method is known as secondary neutral particle mass spectrometry (SNMS). Also in this case, pulsed ions are generated.

Therefore, in order to analyze a sample including special substances, the application of the aforementioned pulsed ionization method is required In the SIMS instruments, the strength of the magnetic field must be changed to analyze ions of different masses. Consequently, it is difficult to apply the pulsed ionization process to the proposed instrument.

It is known that time-of-flight (TOF) mass spectrometry is suited to cases where produced ions are pulsed.

SUMMARY OF THE INVENTION

It is an object of the present invention to provide a direct imaging type SIMS instrument which uses superimposed fields and is capable of making analysis by TOF mass spectrometry.

It is another object of the invention to provide a direct imaging type SIMS instrument which can switch the mode of operation between TOF mass spectrometric mode and direct imaging mode in a short time.

In one embodiment of the invention, a magnetic field and an electric field perpendicular to the magnetic field are superimposed in a region to form a superimposed field mass analyzer The operation mode of the mass analyzer can be switched between direct imaging mode and TOF mass spectrometric mode. In the direct imaging mode, an image of the region of the sample which is irradiated with a primary beam is focused onto a two-dimensional detector. In the TOF mass spectrometric mode, the strength of the magnetic field is reduced to zero to use only the electric field.

Other objects and features of the invention will appear in the course of the description thereof which follows.

DESCRIPTION OF THE PREFERRED EMBODIMENTS

The present applicant has disclosed a new SIMS instrument in U.S. patent application Ser. No. 244,484. This instrument uses a mass analyzer having a region in which a magnetic field and an electric field perpendicular to the magnetic field are superimposed.

Figure 1:
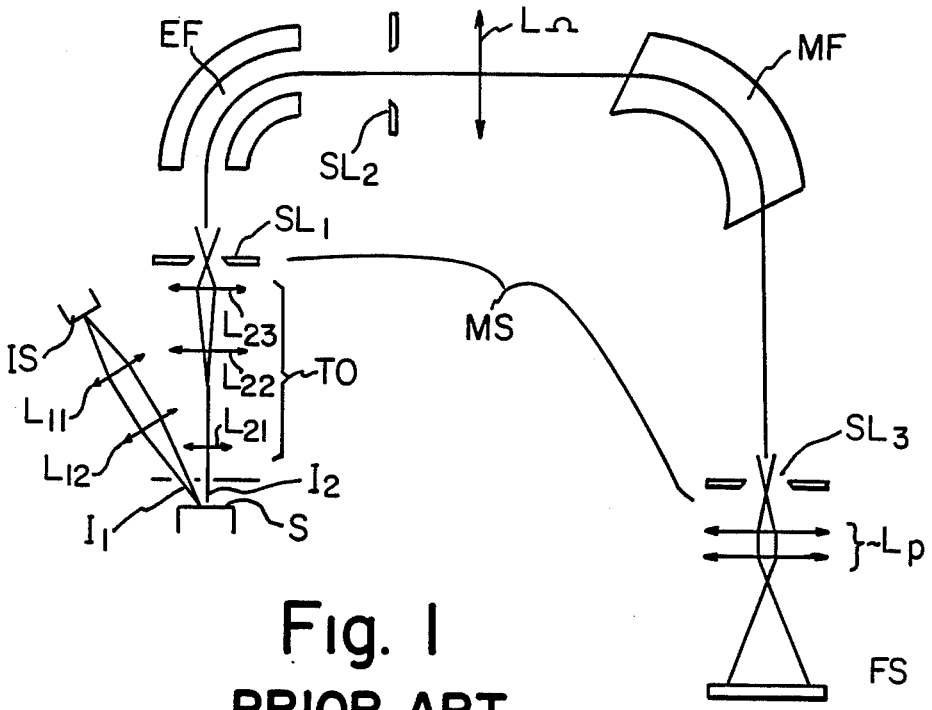
Fig. 1 PRIOR ART
FIG. 1 is a diagram of the ion optics of a conventional direct imaging type SIMS instrument.
Figure 2:
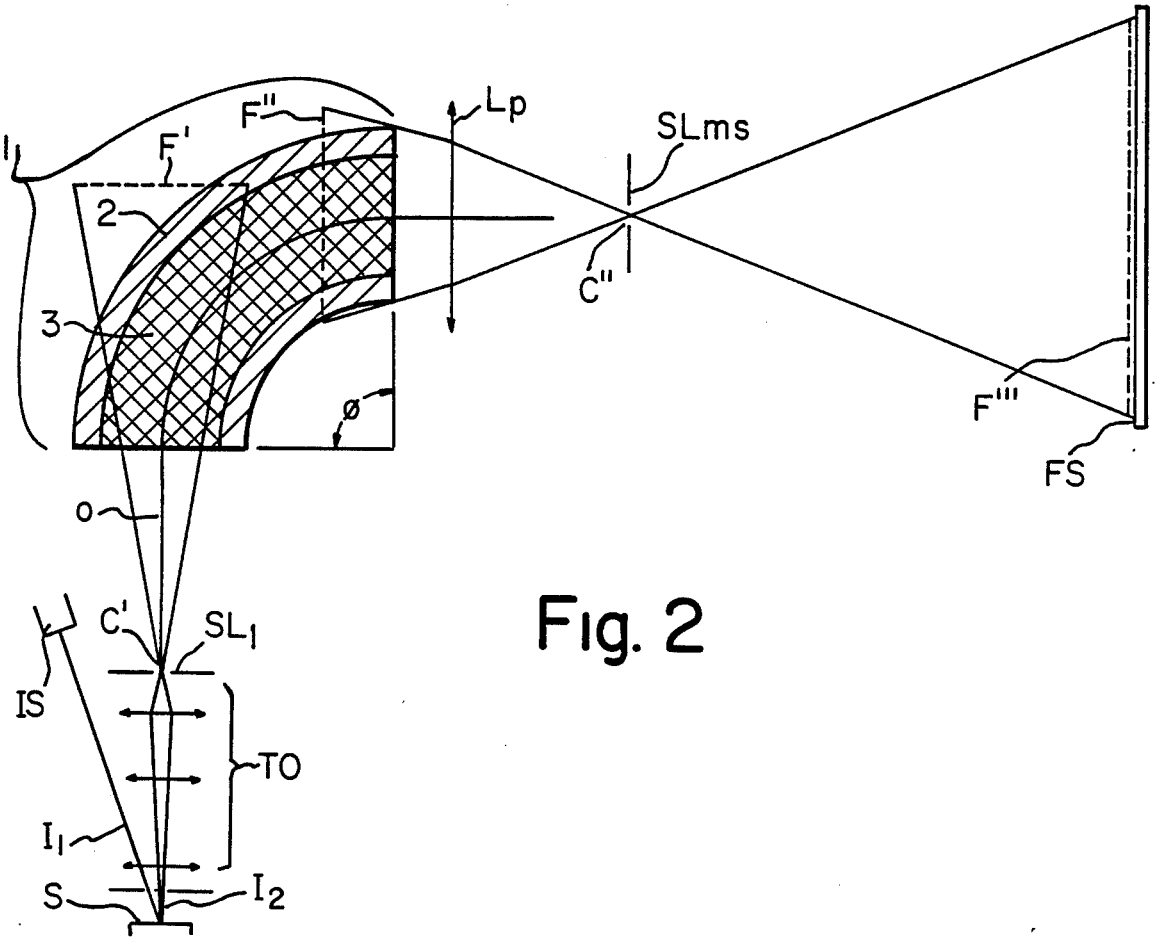
FIG. 2 is a diagram of the ion optics of the direct imaging type SIMS instrument which uses superimposed fields.

Referring to FIG. 2, there is shown the ion optics of the proposed instrument. The ion optics comprises an ion source IS, a transfer optics TO, and an entrance slit $SL_1$. A sample S, the ion source IS, the optics TO, and the slit $SL_1$ are arranged in the same manner as in the conventional ion optics shown in FIG. 1. The ion optics further includes superimposed fields 1 consisting of a toroidal electric field 3 and a uniform magnetic field 2 that is substantially perpendicular to the electric field 3. In this electric field 3, the central orbit 0 of the ion beam is located in an equipotential surface. Also shown are a projector lens Lp, a mass-selecting slit SLms, and a fluorescent screen FS.

In the optics shown in FIG. 2, an ion image F′ of the bombarded sample region is formed by the transfer optics TO. This image is changed into an image F″ by the superimposed fields 1 and then projected as an image F‴ onto the screen FS. The projector lens Lp is used to increase the magnification of the image. This lens Lp can be dispensed with if not necessary.

The crossover C, of the image of the bombarded sample region is formed at the position of the entrance slit $SL_1$ by the transfer optics TO. The superimposed fields create a crossover C″ at the position of the mass-selecting slit SLms. In this state, only mass dispersion takes place at the selecting slit SLms. Only ions of a selected mass which pass through the slit SLms form an ion image of the analyzed region on the fluorescent screen FS. The mass number of ions passing through the slit SLms is changed by varying the intensity of the magnetic field 2 of the superimposed fields 1. In this way, an image can be created from ions having a specified mass number, i.e., a mass-filtered ion image can be obtained.

In order for the optics shown in FIG. 2 to increase the mass separation and to minimize the distortion of the ion image, it is necessary to achieve freedom of distortion and the double-focusing condition simultaneously for both the crossover and the ion image, moreover, a so-called stigmatic focusing condition is required to be satisfied for the ion image.

Figure 3:
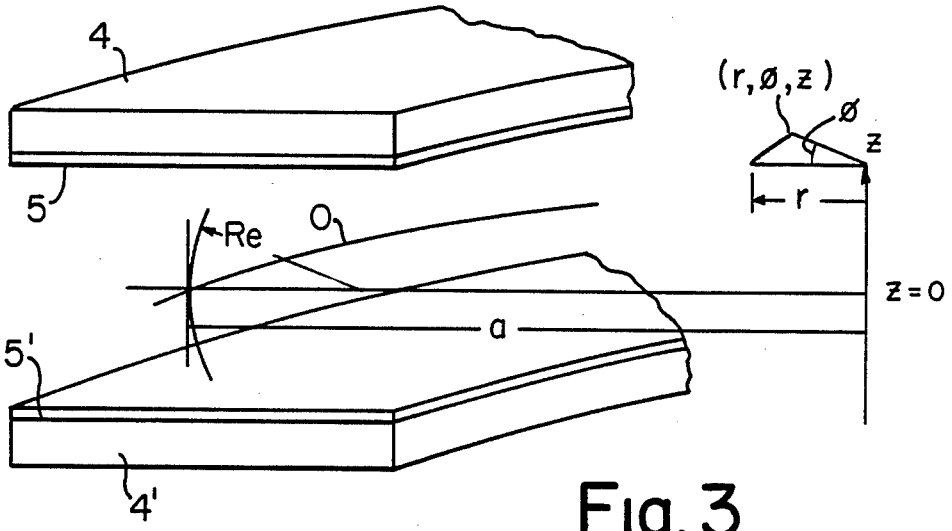
FIG. 3 is a schematic representation of a means for producing superimposed fields.

The motion of ions traveling through superimposed fields consisting of an electric field and a homogeneous magnetic field that is substantially perpendicular to the electric field is now described using a cylindrical coordinate system (r, $\phi$, z) as shown in FIG. 3. In the electric field, the central orbit of the ion beam is placed in an equipotential surface as mentioned previously.

FIG. 3 schematically shows a means for producing the superimposed fields. In FIG. 3, a homogeneous magnetic field is set up between a pair of magnetic pole pieces 4 and 4′ along the z-axis. Base plates 5 and 5′ for producing an electric field are mounted on the surfaces of the pole pieces 4 and 4′, respectively. The structure of these base plates 5 and 5′ is described in detail later. A multiplicity of filament electrodes are arranged coaxially on the surface of each base plate. Adequate potentials are applied to these electrodes to produce an electric field substantially vertical to the magnetic field between the magnetic pole pieces.

It is now assumed that the electric field on the central orbit 0 (that is, z=0, r=a) has a constant strength and faces to the center of the curvature of the central orbit 0. To treat electromagnetic fields near the plane z=0 and the radius r=a, we now introduce the relations $$r=a(1+\rho) \tag{1}$$

$$z=a\zeta \tag{2}$$

where $\rho$ and $\zeta$ are variables which are much smaller than unity.

By first-order approximations, ion orbit equations for determining the orbit of ions in the superimposed fields are given by $$\frac{d^2\rho}{d\phi^2} = -Kr^2\,\rho + \gamma + \left(2 - \frac{a}{a_m}\right)\beta \tag{3}$$

in the r-direction and $$\frac{d^2\zeta}{d\phi^2} = -Kr^2\,\zeta \tag{4}$$

in the z-direction. The coefficients $Kr^2$ and $Kz^2$ are determined according to the property of the electric and magnetic fields. Where the magnetic field is uniform, these coefficients are given by $$Kr^2 = 3 + l - \frac{3a}{a_m} + \left(\frac{a}{a_m}\right)^2 \tag{5}$$

$$Kz^2 = -\left(\frac{a}{a_e} + l\right) \tag{6}$$

The mass m and the velocity v of an ion of interest are given by $$m=m_o(1+\gamma) \tag{7}$$

$$v=v_o(1+\beta) \tag{8}$$

where $\gamma$ is the relative rate of change of the mass, $\beta$ is the relative rate of change of the velocity of the ion, $m_o$ is the mass of ions (hereinafter referred to as the central beam ions) passing through the central orbit, and $v_o$ is the velocity of the central beam ions. Given by $a_m$ is the radius of the central beam ions when only the magnetic field exists. Expressed by $a_e$ is the radius of the central beam ions when only the electric field exists. The relations of these radii to the radius a are given by $$\frac{1}{a} = \frac{1}{a_e} + \frac{1}{a_m} \tag{9}$$

The term l included in equations (5) and (6) above is the first-order Taylor expansion coefficient when the electric field is subjected to Taylor expansion about the central orbit and is given by $$l=-(1+c) \tag{10}$$

where c is the ratio of the radius of curvature a of the central orbit to the radius of curvature Re (see FIG. 3) of the equipotential line which passes through the central orbit and the plane included in the z-axis. Thus, $$c=a/Re \quad (11)$$

where c is a constant representing the property of the electric field. For example, when c=0 (Re=∞), the electric field is cylindrical, when c=1 (Re=a) the electric field is spherical. When $\gamma \neq 0$ and $\gamma \neq 1$, the electric field is toroidal.

The dispersion D at the position of the image in the r-direction is given by $$D = a\,\delta\,(1 + X) \quad (16)$$

$$\delta = \left\{ \gamma + \left( 2 - \frac{a}{a_m} \right) \beta \right\} / Kr^2 \quad (17)$$

We now discuss the dispersion D. Where $a/a_m=2$, hereinafter referred to as the condition (A), equation (17) is changed into the form $$\delta=\gamma/Kr^2$$

This means that only mass dispersion takes place. For the same mass, dispersion is caused neither by the velocities of ions nor by the energies. Consequently, the double-focusing condition holds at every conjugate object and image. Where $a/a_m=0$, hereinafter referred to as the condition (B), i.e., when the intensity of the magnetic field is zero and $a_m=\infty$, equation (17) takes the form $$\delta=(\gamma+2\beta)/Kr^2$$

At this time, ions undergo the force of the electric field. All ions are dispersed according to only the kinetic energies they possess. From equations (5), (6), and (9), we have the relationship $$Kr^2+Kz^2=1+(a/a_e)^2 \quad (18)$$

It can be seen from equation (9) that the relation $a/a_m=2$ included in the condition (A) means $$a/a_e=-1 \quad (19)$$

and that the relation $a/a_m=0$ included in the condition (B) means $$a/a_e=+1 \quad (20)$$

Therefore, under both conditions (A) and (B), equation (18) can be changed into the form $$Kr^2+Kz^2=2 \quad (21)$$

That is, under both conditions (A) and (B), if the relations $Kr^2=Kz^2=1$ are fulfilled, then the stigmatic focusing condition is met.

The condition (A) comprises equations $a/a_m=2$ and $a/a_e=-1$. These two equations are substituted into equations (5) and (6), respectively, to give rise to the relationships $$Kr^2=l+1 \text{ and } Kz^2=1-l$$

It can be understood, therefore, that when l=0, the relations $Kr^2=Kz^2=1$ hold. In order to cater for the relation l=0, the equation $C=-1$ is derived from equation (10). Then from equation (11), the relation Re=−a is required to be satisfied. As shown in FIG. 3, this means that the curvature of radius a is provided in a direction opposite to the direction of the curvature in FIG. 2.

The two equations $a/a_m=0$ and $a/a_e=1$ included in the condition (B) are substituted into equations (5) and (6), respectively. We now get the relations $Kr^2=3+l$ and $Kz^2=-(1+l)$. It can be seen that when $l=-2$, the relationships $Kr^2=Kz^2=1$ hold. To satisfy the relation l equals −2, we obtain the relation c=1 from equation (10). From equation (11), we have the relationship Re=a. This means that the radius of curvature Re shown in FIG. 2 is set equal to a.

Figure 4:
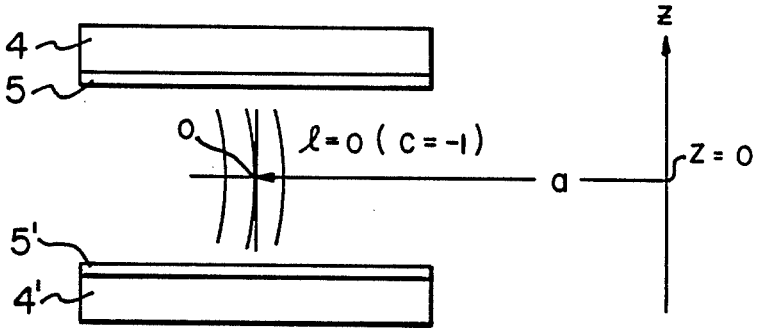
FIG. 4 is a diagram illustrating the distribution of a toroidal electric field with $l=0$.

In summary, (A), the intensity of the magnetic field and the intensity of the electric field are so set that the relations $a/a_m=2$ and $a/a_e=-1$ hold. Also, the distribution of the electric field is produced as shown in FIG. 4 so as to meet the relation l−0.

Under this condition, the mass-filtered ion image projected on the screen FS involves a minimum of distortion. That is, regarding the ion image, the freedom from energy aberration and the stigmatic focusing are simultaneously attained The magnification of this ion image can be set at any desired value without changing the conditions of the superimposed fields by varying the conditions of the transfer optics TO and varying the size of the crossover formed at the position of the entrance slit. Also, it is possible to obtain mass-filtered ion images from various ions, because ions of various masses are allowed to pass through the mass-selecting slit SLms by changing the intensity of the magnetic field of the superimposed fields. Further, a mass spectrum of the sample region irradiated with the primary beam can be obtained by sweeping the intensity of the magnetic field of the superimposed fields and detecting the total ion current incident on the screen FS.

(B) The intensity of the magnetic field is set equal to zero such that the relation $a/a_m=0$ holds. The electric field is produced in a direction opposite to the direction of the field generated in the case of (A) so that the relation $a/a_e=1$ holds; the intensity of the electric field is the same as in the case of (A). The distribution of the electric field is determined to fulfill the relation $l=-2$. Thus, a crossover image is focused such that an energy dispersion occurs at the position of the mass-selecting slit SLms. Ions within the selected energy bandwidth pass through this slit and produce an energy-filtered ion image on the fluorescent screen FS. That is, ions having various masses contribute to the formation of the energy-filtered ion image. Therefore, it can be said that the energy-filtered ion image contains more general information than the information offered by the mass-filtered ion image.

In this way, the SIMS instrument is small in size because of the use of the superimposed fields In addition, it has the advantage that it can obtain energy-filtered ion images, as well as mass-filtered ion images.

Figure 5:
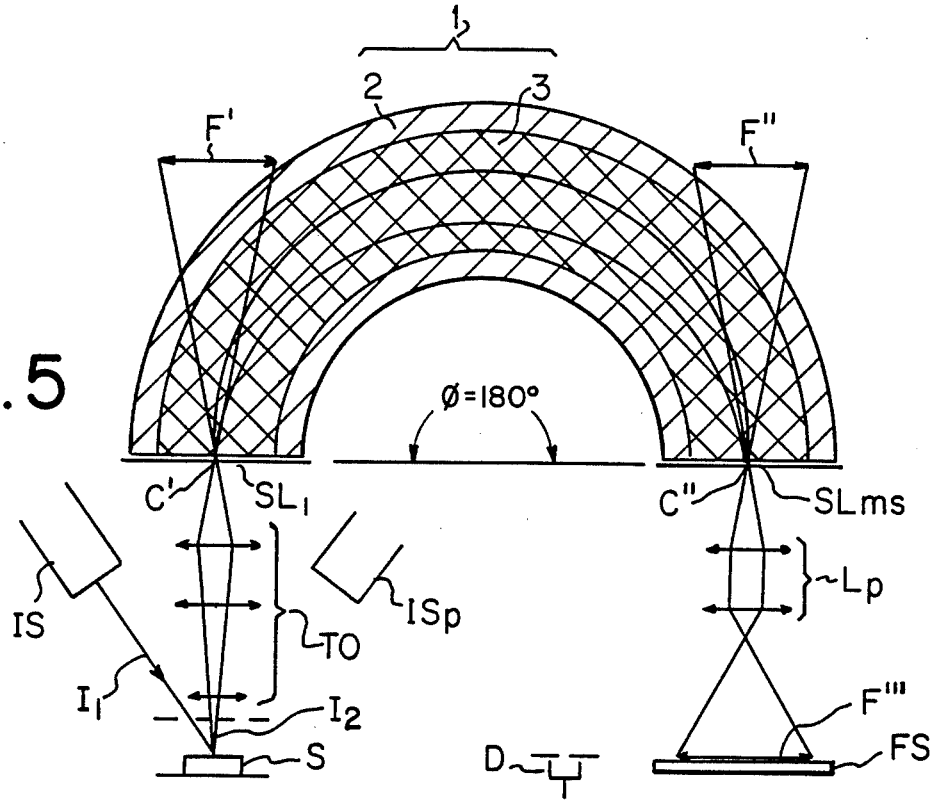
FIG. 5 is a diagram of the ion optics of an instrument according to the invention.

Referring to FIG. 5, there is shown the ion optics of an instrument embodying the concept of the invention. This instrument is similar to the SIMS instrument shown in FIG. 2 except that a pulsed laser source ISp for TOF (time-of-flight) mass spectrometry and an ion detector D are added, and that the deflection angle $\phi$ of ions in the superimposed fields, the position of the entrance slit $SL_1$, and the position of the mass-selecting slit SLms are different. Specifically, the angle $\phi$ is set to approximately 180°. The entrance slit $SL_1$ is located at the entrance of the superimposed fields. The selecting slit SLms is positioned at the exit of the superimposed fields.

Figure 6:
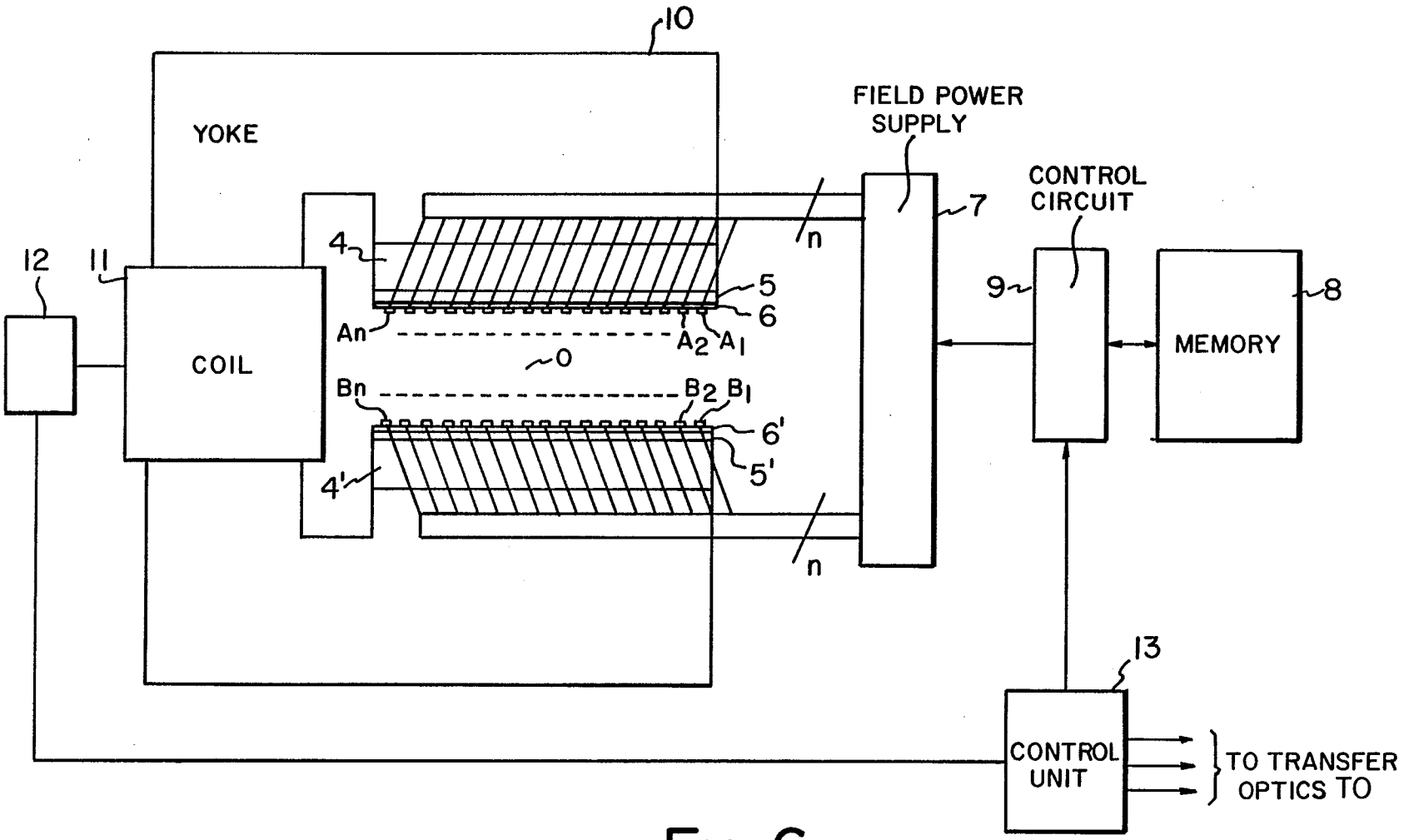
FIG. 6 is a diagram of a means for producing superimposed fields.
Figure 7:
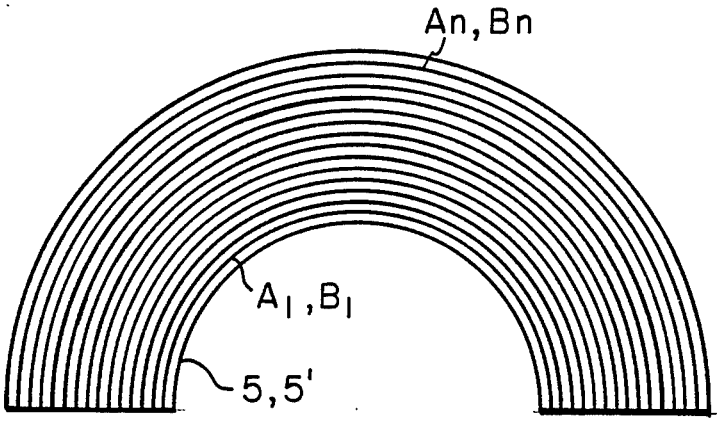
FIG. 7 is a plan view of the base plates 5 and 5′ shown in FIGS. 4 and 6.

The structure of a means for producing superimposed fields consisting of an electric field satisfying either the condition $l=0$ or the condition $l=-2$ and a uniform magnetic field is now described in detail. Referring to FIG. 6, base plates 5 and 5' are made from an insulator such as a ceramic and take the form of an arc extending along the central orbit of ions as shown in FIG. 7. Thin resistor coatings 6 and 6' are formed on the opposite surfaces of the base plates 5 and 5', respectively, by applying a material to the surfaces or by evaporation. A multiplicity of electrodes $A_1-An$ and $B_1-Bn$ of 0.2 mm wide, for example are arranged coaxially on the arc-shaped coatings. The electrodes are spaced 2.0 mm, for example, from each other. The pattern of the electrodes can be created by applying or depositing a conductive material using a mask, for example. Alternatively, the pattern can be created by resist exposure techniques or etching techniques in the same manner as ordinary printed circuit boards. A field power supply 7 applies a certain voltage to each electrode on the base plates via a lead wire. The values of voltages to be applied to all the electrodes $A_1-An$ and $B_1-Bn$ are stored in a memory 8. A reading control circuit 9 causes the voltage values to be read from the memory 8 and supplied to the power supply 7 as information about the voltages applied to the electrodes.

A yoke 10 extends across the magnetic pole pieces 4 and 4', and is excited by an exciting coil 11 which receives exciting current from a magnetic field power supply 12. The operation of the reading control circuit 9, the electric field power supply 7, the magnetic field power supply 12, and the transfer optics TO is controlled by a control unit 13.

The superimposed field-producing means constructed as described above is able to set up a toroidal electric field having a desired coefficient C between the electrodes by setting a voltage to be applied to each electrode in accordance with a predetermined formula The coefficient that is determined from equation (10) can be set to any desired value, using the coefficient C.

Information about the potentials on the electrodes which produce a preset toroidal electric field with $l=0$ ($C=-1$) is stored in the memory 8. Also, other information about the potentials on the electrodes which generate a toroidal electric field with $l=-2(C=1)$ is stored in the memory 8.

Direct Imaging Mode

In this mode, the ion source IS is used. The sample S is continuously irradiated with a primary ion beam $I_1$. As described already, in this mode, either a mass-filtered ion image or an energy-filtered ion image is formed for mass analysis When the instrument is so set up that a mass-filtered ion image is formed, the reading control circuit 9 reads information on the toroidal electric field with $l=0(c=-1)$ from the memory 8 under the control of the control unit 13. Then, the control unit 13 produces a toroidal electric field having a distribution satisfying the relation $l=0$. Also, the strength and the direction of the field meets the relationship $a/a_e=-1$. In addition, the magnetic power source produces a uniform magnetic field whose intensity fulfills the relation $a/a_m=2$. Since the relation $l=0$ is met, the relations $Kr^2=Kz^2$ hold. Therefore, stigmatic focusing is achieved. Since the relations $a/a_e=-1$ and $a/a_m2$ hold, energy convergence is attained.

As shown in FIG. 5, the control circuit 13 controls the transfer optics TO in such a way that the first crossover point C' is focused at the position of the entrance slit $SL_1$ which is located at the entrance of the superimposed fields. The second crossover point C'' is focused at the position of the mass-selecting slit SLms by the superimposed fields. Ions which have the same mass and are passed through this slit form a mass-filtered ion image on the fluorescent screen FS.

When the instrument is so set up that an energy-filtered ion image is formed, the control unit 13 instructs the reading control circuit 9 to read information about the toroidal electric field with $l=-2(c=1)$ from the memory 8. Based on the information read out, a toroidal electric field whose distribution satisfies the relation $l=-2$ is developed. The intensity and the direction of the field are such that the relationship $a/a_e=1$ is met. The excitation current from the magnetic field power supply is cut off to reduce the intensity of the magnetic field down to zero. The crossover points are adjusted in exactly the same manner as when the mass-filtered ion image is formed. Thus, a crossover image in which ions are separated according to energy is focused at the position of the mass-selecting slit SLms. The ions which are passed through the slit and have the same energy form an energy-filtered ion image on the fluorescent screen FS.

TOF Mass Spectroscopic Mode

In this mode, the pulsed laser source ISp is used. A pulsed laser beam, for example, is directed to the sample S. Instead of the fluorescent screen FS, the ion detector D is disposed in the ion path. In this mode, the operating conditions of the electric and magnetic fields are the same as the conditions set up when an energy-filtered ion image is formed. In particular, the control unit 13 orders the reading control circuit 9 to read information concerning the toroidal electric field with $l=-2(c=1)$ from the memory 8. According to the information, a toroidal electric field is produced in such a way that its distribution satisfies the relation $l=-2$ and that its strength and direction cater for the relation $a/a_e=1$. The supply of the excitation current from the magnetic field power supply is cut off to reduce the magnetic field intensity down to zero. Since the relationship $l=-2$ holds, the relations $Kr^2=Kz^2=1$ are satisfied. Hence, stigmatic focusing is realized.

Figure 8:
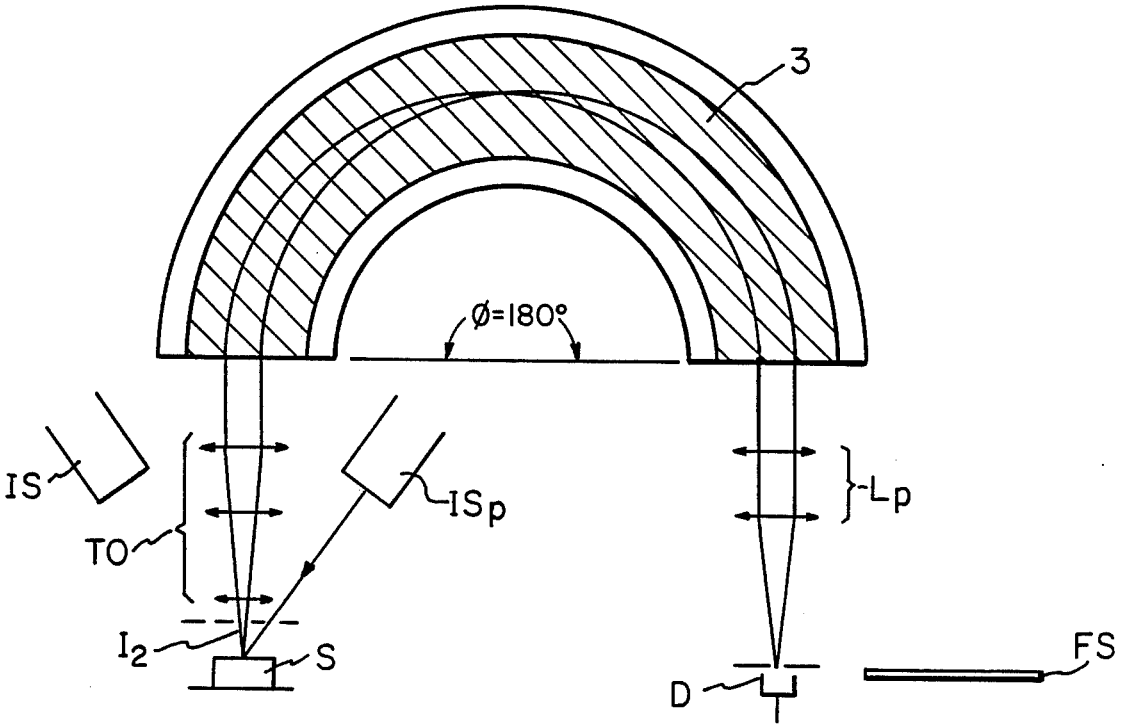
FIG. 8 is a diagram similar to FIG. 5, but in which the mass spectrometer operates in TOF mass spectrometric mode.

The control unit 13 controls the transfer optics TO in such a manner that ions $I_2$ emanating from the sample enters the toroidal electric field as a parallel beam, as shown in FIG. 8. The ion beam is once converged at the middle point of the path within the electric field. Then, the beam leaves the electric field as a parallel beam. A slit may be disposed at the converging middle point in the field to remove unwanted ions. The ions exiting from the toroidal electric field as a parallel beam are focused onto the ion detector D by a projector lens Lp controlled by the control unit 13, and the ions are detected. To pass the parallel beam, the entrance slit $SL_1$ and the mass-selecting slit SLms are moved off the optical path or opened. A TOF instrument having such ion optics is called Poshenrieder mass spectrometer (*Int. J. Mass Spectrom Ion Phys.*, 9, (1972)).

The bombardment of the pulsed laser beam from the pulsed laser source produces a bunch of secondary ions from the surface of the sample. The secondary ions produced in a quite short time are separated according to mass with the lapse of time on the principle of TOF mass spectroscopy. The ions arrive at the ion detector D one after another and are detected The obtained data representing a mass spectrum is stored in a memory (not shown).

Figure 9:
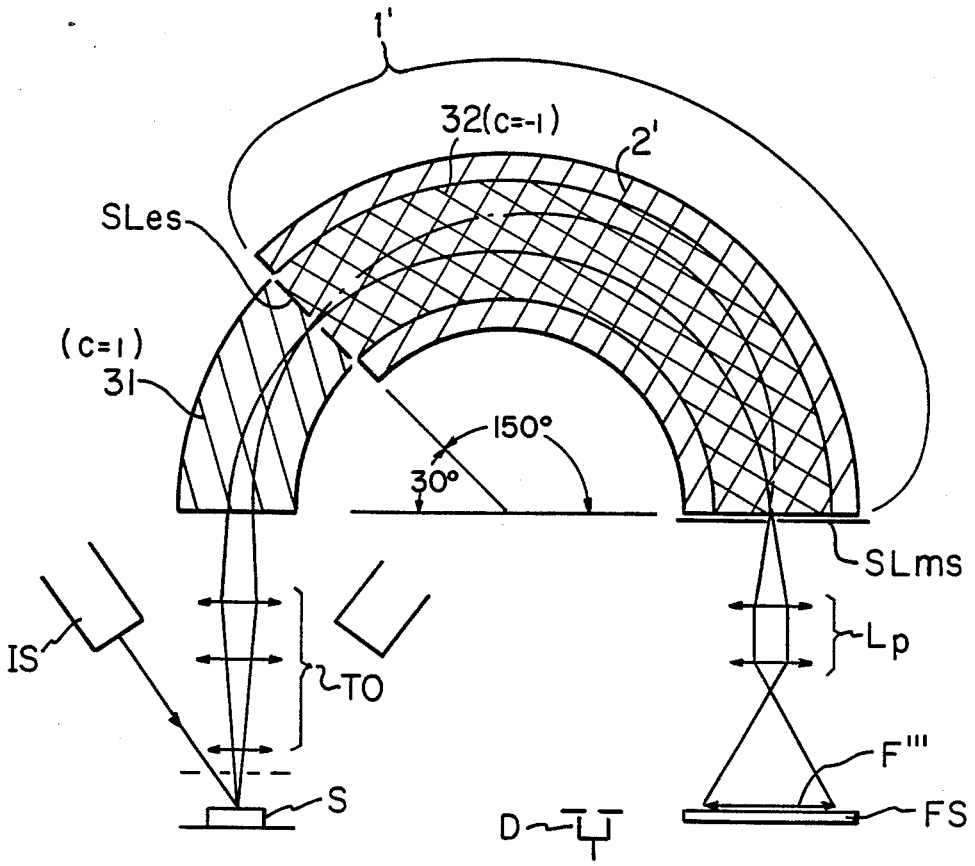
FIG. 9 is a diagram of the ion optics of another instrument according to the invention.

Referring next to FIG. 9, there is shown another instrument according to the invention. In this example, the toroidal electric field is divided into electric fields 31 and 32 in which the deflection angle $\phi$ is set to 30° and 150°, respectively. The fields are energized by their respective power supplies so that their coefficients c can be set separately. Since a uniform magnetic field 2' where the deflection angle $\phi$ is 150° is just superimposed on the electric field 32, superimposed fields 1' with $\phi=150°$ are formed.

Direct Imaging Mode

In this mode, the electric field 31 is so set up that the relations $a/a_e=1$ and $c=1(Kr^2=Kz^2=1)$ are satisfied. The electric field 32 of the superimposed fields 1' is produced so as to meet the relationships $a/a_e-1$ and $c=-1$ $(Kr^2=Kz^2=1)$. The uniform magnetic field 2' of the superimposed fields 1' is so generated that the relation $a/a_m=2$ holds. Further, the transfer optics TO is adjusted in such a way that a crossover C' is formed between the electric field 31 and the superimposed fields 1'. An energy-selecting slit SLes is located at the position of this crossover C'. This slit permits only ions having energies lying within a desired range to be introduced into the superimposed fields 1'.

A mass-filtered ion image is formed on the fluorescent screen FS by the action of the ion optics described above. It is necessary to form an intermediate ion image in the center of the electric field 31 to obtain an achromatic ion image.

TOF Mass Spectrometric Mode

In this mode, both electric fields 31 and 32 are so produced that the relations $a/a_e=1$ and $c=1(Kr^2=Kz^2=1)$ hold. The coupling between the two electric fields substantially produces a toroidal electric field which meets the requirements $\phi=180°$, $a/a_e=1$, and $c=1$. Therefore, in this mode, the present example is exactly equivalent to the example shown in FIG. 8.

While the invention has been particularly shown and described with reference to preferred embodiments thereof, it will be understood by those skilled in the art that various changes and modifications may be made therein. For instance, the value of the angle $\phi$ is not limited to 180°; it can also be set to other appropriate values.

Having thus described our invention with the detail and particularity required by the Patent Laws, what is claimed and desired to be protected by Letters Patent is set forth in the following claims.

What is claimed is:

1. A direct imaging type SIMS instrument comprising:

a beam source for producing a primary beam directed to a sample position to cause emanation of secondary ions from a sample at said position;

a mass analyzer into which are introduced the secondary ions emanating from the sample at the sample position, the mass analyzer comprising a magnetic field and a superimposed electric field perpendicular to the magnetic field; and a first ion detector disposed at the output of the mass analyzer for displaying a two-dimensional direct image, a second ion detector means for detecting a time-of-flight (TOF) spectrum, and means for switching the mode of operation of the SIMS instrument between a direct imaging mode in which an image of the sample region irradiated with the primary beam is focused onto the first ion detector and a time-of-flight (TOF) mass spectrometric mode in which the TOF spectrum is recorded at the second ion detector and in which the intensity of the magnetic field of the superimposed fields in the mass analyzer is reduced down to zero to only use the electric field.

2. The direct imaging type SIMS instrument of claim wherein the angle through which ions are deflected in the superimposed fields is set to 180°.

3. The direct imaging type SIMS instrument of claims 1 or 2, further including a pulsed ion source for producing a pulsed primary beam to the sample in the TOF spectrometric mode and said first ion detector detecting the secondary ions which are produced in response to the pulsed irradiation of the primary beam and passed through the electric field.

4. The direct imaging type SIMS instrument of claim 3, wherein the second ion detector used in the TOF mass spectrometric mode is placed in the ion path in a complementary relation to the first ion detector used in the direct imaging mode.

5. The direct imaging type SIMS instrument of claim 4, wherein said primary beam is a laser beam.

* * * * *

UNITED STATES PATENT AND TRADEMARK OFFICE

CERTIFICATE OF CORRECTION

PATENT NO. : 4,945,236

DATED : July 31, 1990

INVENTOR(S) : Akinori Mogami and Motohiro Naitoh

It is certified that error appears in the above-identified patent and that said Letters Patent is hereby corrected as shown below:

Column 2 Line 15 after "required" insert --.--.

Column 2 Line 36 after "analyzer" insert --.--.

Column 2 Line 57 "1" should read -- ℓ --.

Column 3 Line 5 "patent application" should read --Patent Application--.

Column 3 Line 29 "C," should read --C'--.

Column 4 Line 58 "1" should read -- ℓ --.

Column 5 Line 64 "1" should read -- ℓ --.

Column 5 line 66 "1" first occurrence should read -- ℓ --.

Column 6 Line 8 "1" (second occurrence) should read -- ℓ --.

Column 6 Line 17 "1" should read -- ℓ --.

Column 6 Line 22 after "attained" insert --.--.

UNITED STATES PATENT AND TRADEMARK OFFICE

CERTIFICATE OF CORRECTION

PATENT NO. : 4,945,236

DATED : July 31, 1990

INVENTOR(S) : Akinori Mogami and Motohiro Naitoh

It is certified that error appears in the above-identified patent and that said Letters Patent is hereby corrected as shown below:

Column 6 Line 55 after "fields" insert --.--.

Column 7 Line 5 "1" should read -- ℓ --.

Column 7 Line 41 after "formula" insert --.--.

Column 7 Line 45 "1" should read -- ℓ --.

Column 7 Line 56 after "analysis" insert --.--.

Column 7 Line 60 "1=0(c=-1)" should read -- ℓ =0 (c=-1)--.

Column 7 Line 63 "1" should read -- ℓ --.

Column 7 Line 67 "1" should read -- ℓ --.

Column 7 Line 68 before "hold" insert --1--.

Column 9 Line 4 after "detected" insert --.--.

Claim 2 Line 33 Column 10 after "claim" insert --1,--.

Signed and Sealed this

Eighteenth Day of February, 1992

*Attest:*

HARRY F. MANBECK, JR.

*Attesting Officer*

*Commissioner of Patents and Trademarks*